US007744310B2

(12) United States Patent
Alpern et al.

(10) Patent No.: US 7,744,310 B2
(45) Date of Patent: Jun. 29, 2010

(54) HYDROSTATICALLY OPERATED VARIABLE HEIGHT BULKHEAD

(75) Inventors: Robert L. Alpern, Westfield, NJ (US); Diane S. Rahoy, Roselle Park, NJ (US); David N. Rackmales, New York, NY (US)

(73) Assignee: The United States of America as reprensented by the Secretary of the Army, Washington, DC (US)

( * ) Notice: Subject to any disclaimer, the term of this patent is extended or adjusted under 35 U.S.C. 154(b) by 318 days.

(21) Appl. No.: 12/006,757

(22) Filed: Jan. 2, 2008

(65) Prior Publication Data

US 2009/0169302 A1 Jul. 2, 2009

(51) Int. Cl.
*E02B 7/26* (2006.01)

(52) U.S. Cl. ..... 405/104; 405/87; 405/92; 405/96; 405/103

(58) Field of Classification Search ..... 405/21, 405/26, 80, 83, 87, 90, 91, 92, 96, 97, 103, 405/104, 107, 111, 112, 114; 49/10, 11, 49/21

See application file for complete search history.

(56) References Cited

U.S. PATENT DOCUMENTS 4,406,564 A 9/1983 Hanson
4,691,661 A 9/1987 Deiana
4,850,742 A 7/1989 Bouchet et al.
5,460,462 A * 10/1995 Regan ..... 405/96
5,725,326 A * 3/1998 Van den Noort ..... 405/104
6,338,594 B1 * 1/2002 Adler et al. ..... 405/97
6,893,191 B2 5/2005 Weyant et al.
6,932,539 B2 8/2005 Benedict
7,189,026 B2 3/2007 King et al.
2007/0166110 A1 * 7/2007 Kenady ..... 405/224

FOREIGN PATENT DOCUMENTS

JP 62268410 A * 11/1987

* cited by examiner

*Primary Examiner*—David J Bagnell
*Assistant Examiner*—Benjamin Fiorello
(74) *Attorney, Agent, or Firm*—Earl H. Baugher, Jr.

(57) ABSTRACT

A self-adjusting barrier incorporates a series of float units restrained between a primary wall, such as a bulkhead, and a secondary wall, such as sheetpile. The secondary wall may be braced to the primary wall. The float units slidably interconnect along adjacent edges to self-adjust along a perimeter, such as a marina or waterfront lot, based on the height of water within the chamber (stilling basin) provided between the two walls. Mechanisms for deterring vandalism and providing increased environmental integrity are also provided for select embodiments. Methods of employing the barrier are also disclosed.

25 Claims, 13 Drawing Sheets

HYDROSTATICALLY OPERATED VARIABLE HEIGHT BULKHEAD

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees. Please contact Phillip Stewart at 601 634-4113.

BACKGROUND

It is important to protect waterfront properties from damage due to storm surges. Conventionally, permanent bulkheads are used for this purpose. For many waterfront property owners, the view of the waterway or waves breaking on the beach is highly desirable and high bulkheads restrict this view. Owner-preferred low bulkheads require pumps to address wave-induced overtopping from storm surges. Thus, an alternative inexpensive bulkhead that adjusts vertically using only the mechanism of rising water level is desirable. In particular, the adjusting bulkhead should not require operator attention, pumping or active control mechanisms for its continued operation.

DETAILED DESCRIPTION

Figure 1:
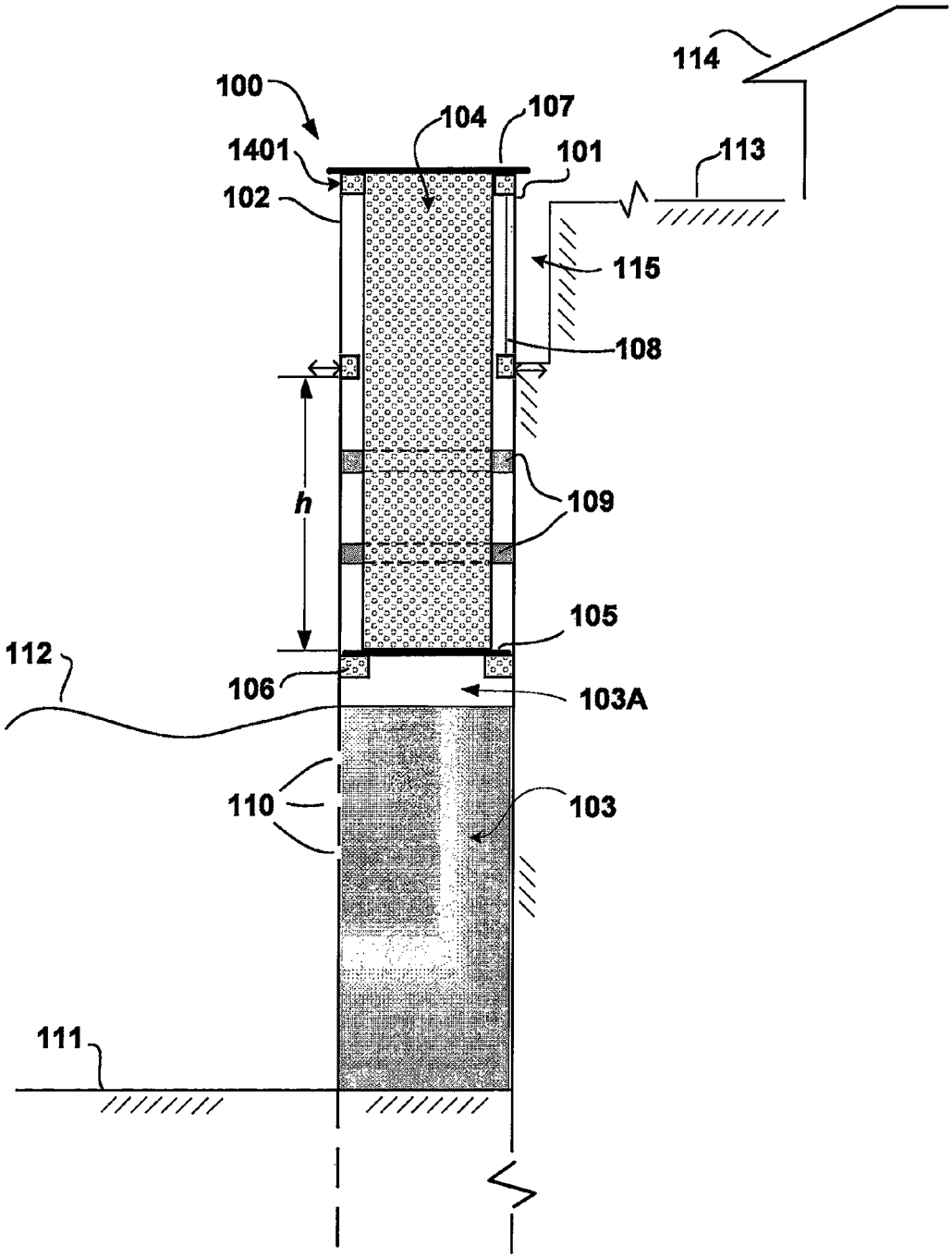
FIG. 1 is an edge view of a select embodiment of the present invention in an un-extended position.

Refer to FIG. 1. A self-adjusting barrier 100 to fluid overtopping comprises one or more first vertical sections 101, such as a bulkhead; one or more second vertical sections 102, such as sheetpile, the second vertical sections 102 spaced apart from the first vertical sections 101 to create a chamber 103 between them, the second vertical section 102 rising to approximately the same height as the first vertical section 101 and in approximately parallel relation thereto, the second vertical section 102 further incorporating one or more passage ways 110 permitting fluid to penetrate the chamber 103, the chamber 103 subsequently serving as a stilling basin; one or more float units 104 slidably restrained in the chamber 103, the float units 104 to be lifted by hydrostatic force to increase the capacity of the barrier 100 to withstand overtopping, the longitudinal axis of the float unit 104 approximately vertical and parallel to the first 101 and second 102 vertical sections. In select embodiments of the present invention, the float unit 104 is approximately rectangular in its cross section perpendicular to the longitudinal axis such that the length of the longitudinal axis is greater than the width of the float unit 104 and the width of the float unit 104 is approximately parallel to the vertical sections 101, 102, the width being greater than the depth of the float unit 104, the depth being approximately perpendicular to the vertical sections 101, 102. In select embodiments of the present invention, the float unit 104 is approximately rectangular in its cross section perpendicular to the longitudinal axis such that the length of the longitudinal axis is less than the width of the float unit 104 and the width of the float unit 104 is approximately parallel to the vertical sections, the width being greater than or equal to the depth of the float unit 104, the depth being approximately perpendicular to the vertical sections 101, 102.

In select embodiments of the present invention, the first and second vertical sections 101, 102 comprise sheet pile.

In select embodiments of the present invention, the first vertical section 101 comprises a bulkhead.

In select embodiments of the present invention, the second vertical sections 102 are connected to first vertical sections 101 by braces 109. In select embodiments of the present invention, the braces 109 are horizontal, approximately perpendicular to the first 101 and second 102 vertical sections. In select embodiments of the present invention, the braces 109 are attached to the first 101 and second 102 vertical sections by means such as: welds, through bolts, glue, nails, screws, and combinations thereof.

Figure 3:
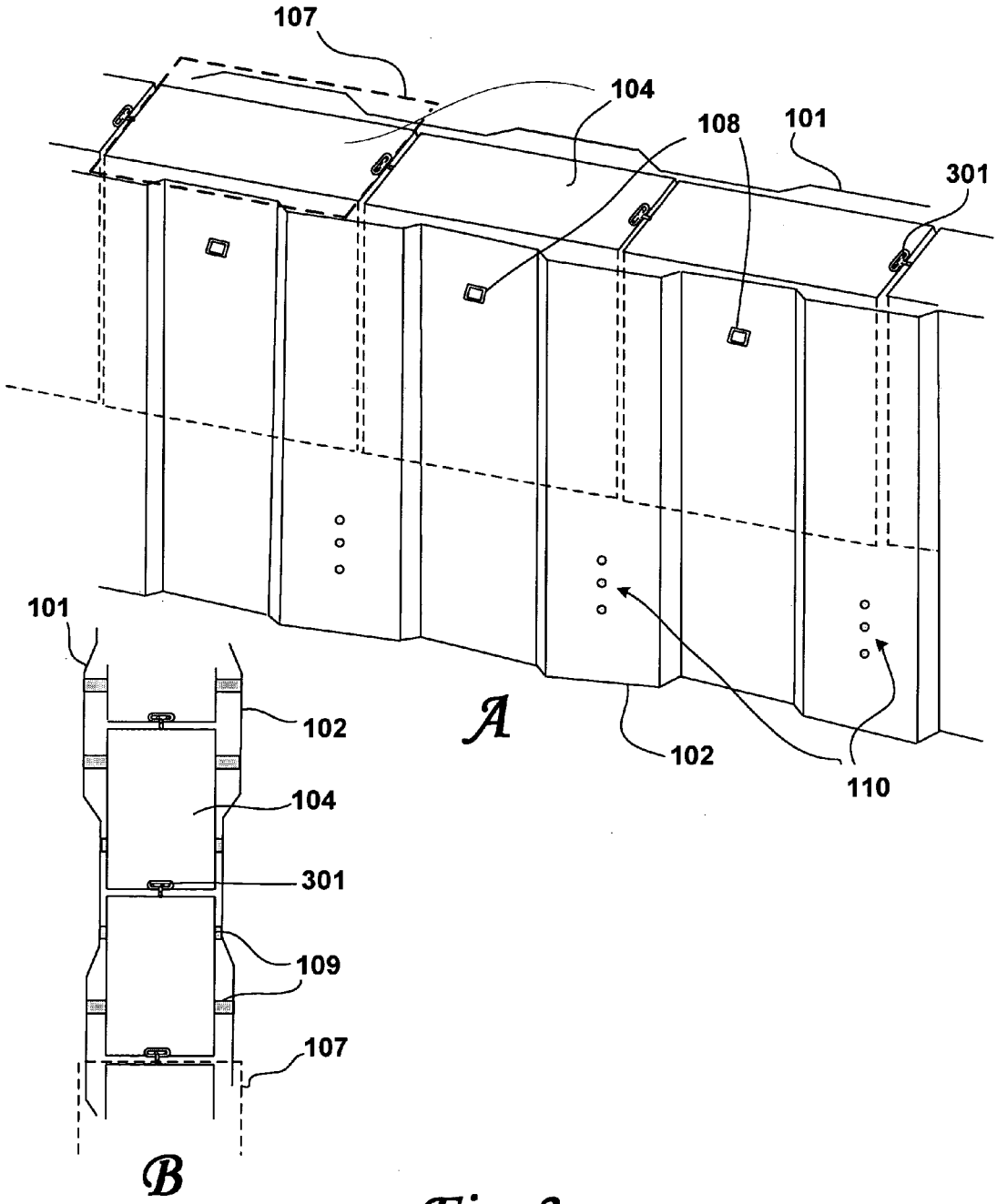
FIG. 3A is a perspective view of a select embodiment of the present invention that employs sheet pile as containment for the embodiment.
FIG. 3B is a top view of a select embodiment of the present invention as represented in FIG. 3A.

In select embodiments of the present invention, the float units 104 comprise material resistant to corrosion and having a density less than water. In select embodiments of the present invention, multiple float units 104 are slidably interconnected in one plane, the plane coincident with the longitudinal axis of the float units 104 and approximately parallel to the vertical sections 101, 102. In select embodiments of the present invention, the float units 104 slidably interconnect with adjacent float units 104 via a tab and slot arrangement 301 as shown in FIG. 3.

Figure 4:
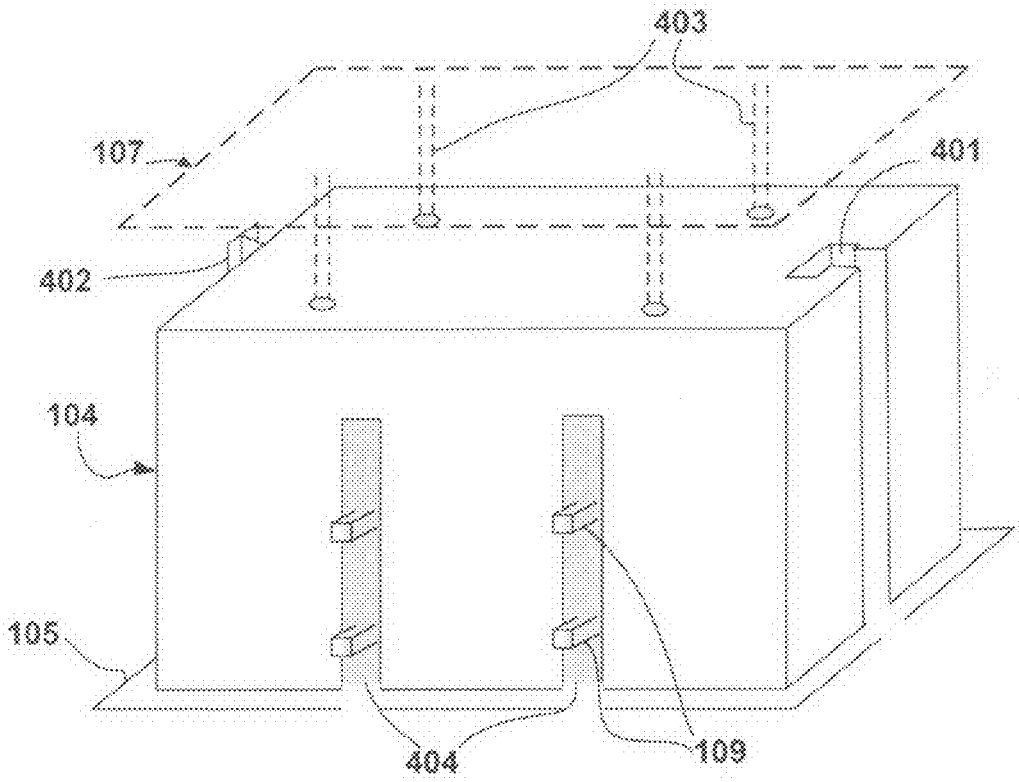
FIG. 4 depicts detail of a portion of a select embodiment of the present invention showing means for stabilization, connection and physical protection of the embodiment.
Figure 8:
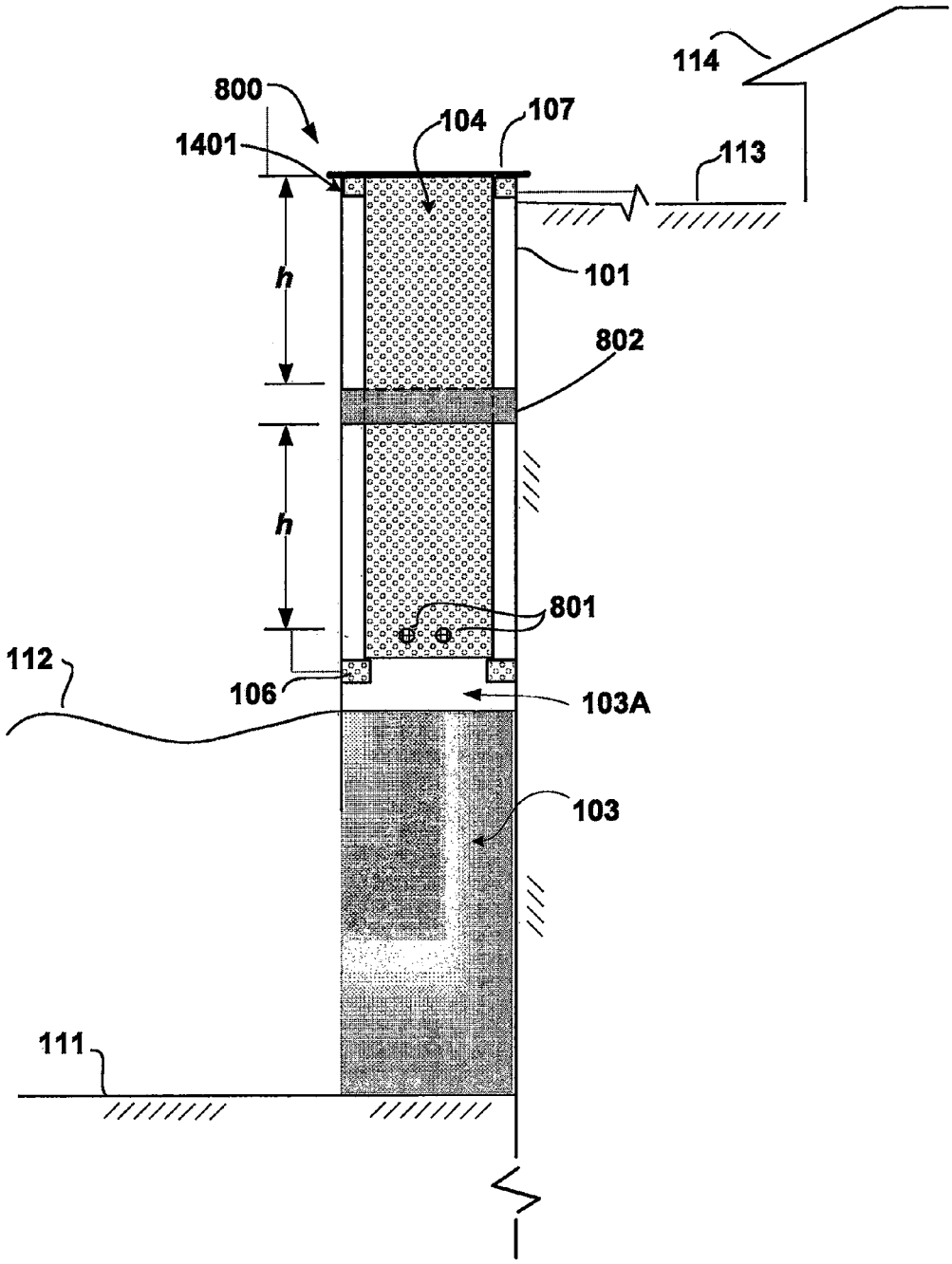
FIG. 8 is an edge view of an alternative to the embodiment of FIG. 1, also in an un-extended position.

Refer also to FIGS. 4 and 8. In select embodiments of the present invention, the float units 104 are formed to include two guide slots 404 permitting braces 802 to pass through opposing longitudinal sides of the float units 104 such that the guide slots 404 allow vertical movement of the float units 104 with changes in fluid level and the float units 104 rest on the top of braces 802 in the lowest position of the float units 104. In select embodiments of the present invention the vertical sections 104 incorporate removable keyed stops 108 and the float units incorporate a bottom plate 105 having a flange 105, such that the flange 105 prevents the float units 104 from rising beyond a pre-specified design elevation by contact with the keyed stops 108 on the vertical sections 101, 102 and the keyed stops 108 prevent vandalism while facilitating installation and maintenance of the barrier 100.

In select embodiments of the present invention, the float units 104 incorporate conducting holes near the bottom through which rods 801, pipes, or the like are inserted. The pipes or rods 801 contact the bottom of the braces 802 when the float unit 104 is in its uppermost raised position, thereby preventing the float unit 104 from rising beyond a pre-specified height.

Figure 5:
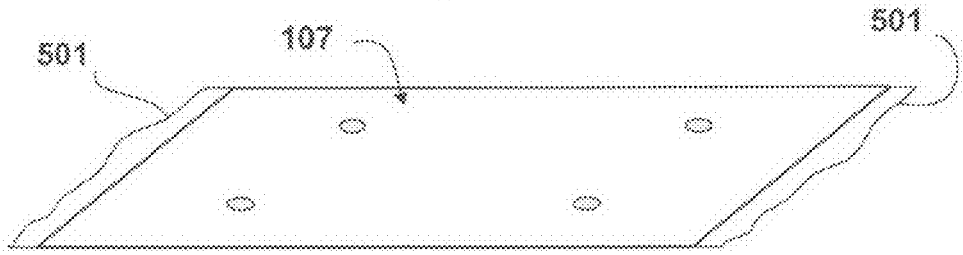
FIG. 5 depicts an embodiment of a top plate that may be used in select embodiments of the present invention.

Refer also to FIG. 5. In select embodiments of the present invention, the float unit 104 incorporates a top plate 107, such that the top plate 107 extends over the tops of both first 101 and second 102 vertical sections to reduce fouling by debris and to provide an aesthetically pleasing top surface, and such that the top plate 107 may serve as a stop preventing the float unit 104 from sinking lower into the chamber 103. In select embodiments of the present invention, the top plate 107 incorporates seals 501 that close the gaps between float units 104. In select embodiments of the present invention, the seals 501 are selected from materials such as: flexible material, neoprene, rigid material, aluminum plate, and combinations thereof.

Figure 2:
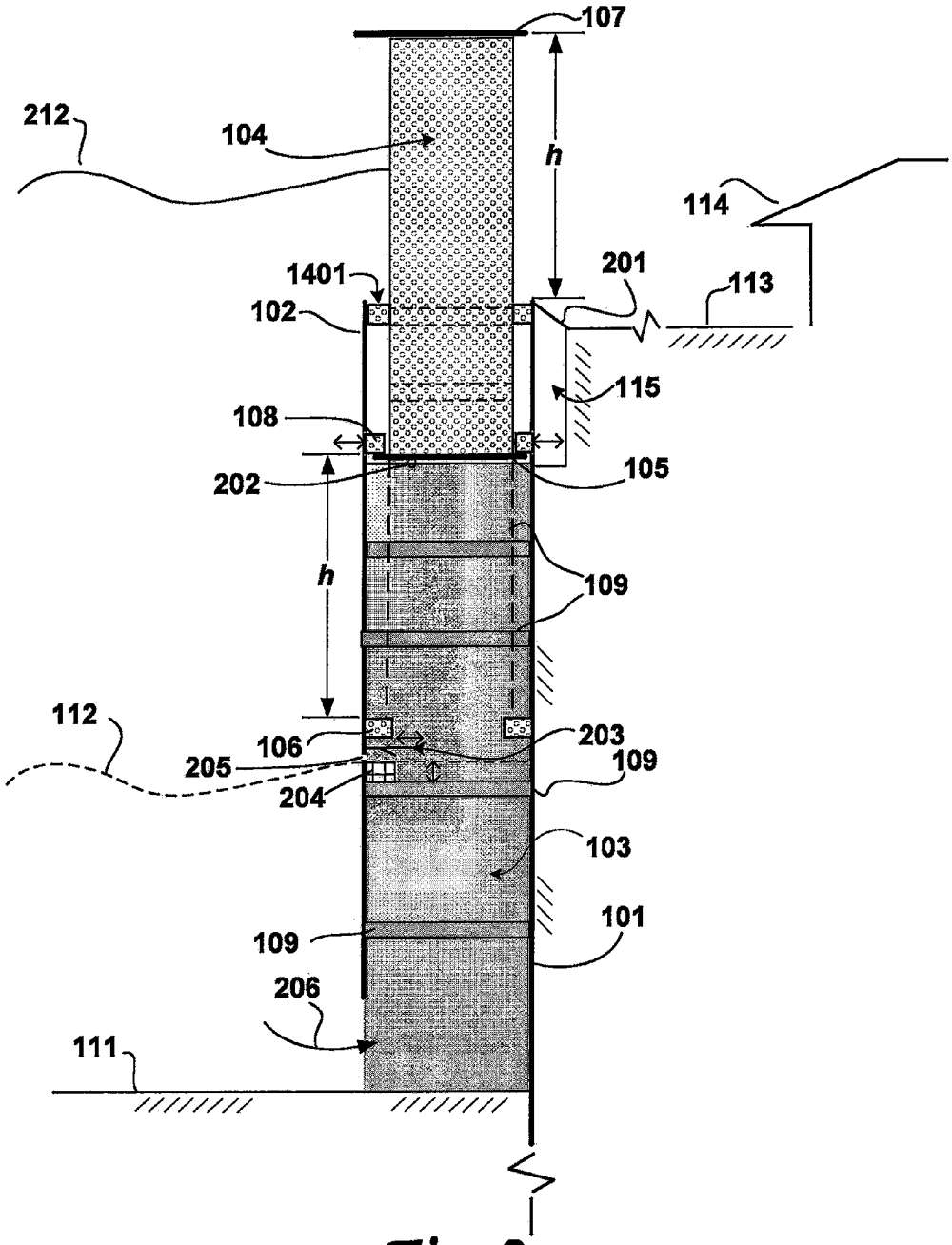
FIG. 2 is an edge view of a select embodiment of the present invention in an extended position.

Refer also to FIGS. 2 and 5. In select embodiments of the present invention one or more of the vertical sections 101, 102 are buried in the earth to facilitate stabilizing the barrier 100. In select embodiments of the present invention, the float unit 104 incorporates one or more keyed anchorages 203 to the secondary ("wet side") vertical section 102 until an event causes the fluid in the chamber 103 to float the float units 104, thus moving the float units 104 vertically in the chamber 103, and wherein the keyed anchorage 203 prevents vandals from lifting the float units 104 from the bather 100 while permitting maintenance to be carried out on the bather 100. In select embodiments of the present invention, the vertical sections 101, 102 incorporate resting stops 106 such that the flanges of the bottom plate 105 of the float units 104 contact the resting stops 106, supporting the float units 104 when conditions are normal and overtopping is not imminent. In select embodiments of the present invention, the self-adjusting bather 100 incorporates one or more water and debris seals 501, the seals 501 providing protection against elevated stilling basin levels.

In select embodiments of the present invention, the keyed anchorage 203, resting stops 106, bottom plates 105 and multiple braces 109 are replaced by a rod and brace configuration as shown in FIGS. 8-11. Two rods (or pipes) 801 may be emplaced in the holes toward the bottom end of the float units 104 for the purpose of providing a stop that prevents the float units 104 from floating out of the chamber 103. A single wide brace 802 installed near the top of the chamber 103 is contacted by the rods and acts as a stop. This system is simpler than the above keyed anchorage, requiring no moving parts to operate. The float units 104, if sufficiently light, may be pried from their resting position, i.e., raised, by vandals, however.

In select embodiments of the present invention, a method for employing a self-adjusting barrier 100 to fluid overtopping comprises: providing one or more first vertical sections 101; providing one or more second vertical sections 102 spaced apart from the first vertical sections 101, thus creating a chamber 103 between the first 101 and second 102 vertical sections, the second vertical section 102 rising to approximately the same height as the first vertical section 101 and in approximately parallel relation thereto, such that the second vertical section 102 incorporates one or more passage ways 110 permitting the fluid to penetrate the chamber 103, the chamber 103 subsequently serving as a stilling basin; providing one or more float units 104 slidably restrained in the chamber 103 such that the float unit 104 is lifted by hydrostatic force to increase the capacity of the barrier 100 to withstand overtopping and such that the longitudinal axis of the float unit 104 is approximately vertical and parallel to the vertical sections 101, 102. In select embodiments of the present invention, the float unit 104 is provided in an approximately rectangular cross section that is perpendicular to the longitudinal axis and the length of the longitudinal axis is greater than the width of the float unit 104 and the width of the float unit 104 is approximately parallel the vertical sections 101, 102, the width being greater than the depth of the float unit 104, the depth being approximately perpendicular to the vertical sections 101, 102. In select embodiments of the present invention, the float unit 104 is provided in an approximately rectangular cross section that is perpendicular to the longitudinal axis and the length of the longitudinal axis is less than the width of the float unit 104 and the width of the float unit 104 is approximately parallel the vertical sections 101, 102, the width being greater than or equal to the depth of the float unit 104, the depth being approximately perpendicular to the vertical sections 101, 102.

In select embodiments of the present invention, a method for adding a self-adjusting barrier 100 to an existing bulkhead 101 to prevent fluid overtopping comprises: providing one or more vertical sections 102 spaced apart from the bulkhead 101 thereby creating a chamber 103 between the vertical sections 102 and the bulkhead 101, the vertical sections 102 rising to approximately the same height as the bulkhead 101 and in approximately parallel relation to the bulkhead 101, such that one or more of the vertical sections 102 incorporate one or more passage ways 110 permitting the fluid to penetrate the chamber 103, the chamber 103 subsequently serving as a stilling basin; providing one or more float units 104 slidably restrained in the chamber 103, the float units 104 lifted by hydrostatic force as the fluid in the stilling basin rises, thus increasing the capacity of the bulkhead 101 to withstand overtopping, such that the longitudinal axis of a float unit 104 is approximately vertical and parallel to the vertical section 102 and bulkhead 101. In select embodiments of the present invention, the float unit 104 is provided in an approximately rectangular cross section perpendicular to the longitudinal axis and the length of the longitudinal axis is greater than the width of the float unit 104 and the width of the float unit 104 is approximately parallel to the vertical section 102 and the bulkhead 101, the width of the float unit 104 being greater than the depth of the float unit 104, the depth being approximately perpendicular to the vertical section 102 and the bulkhead 101. In select embodiments of the present invention, the float unit 104 is provided in an approximately rectangular cross section that is perpendicular to the longitudinal axis and the length of the longitudinal axis is less than the width of the float unit 104 and the width of the float unit 104 is approximately parallel the vertical sections 101, 102, the width being greater than or equal to the depth of the float unit 104, the depth being approximately perpendicular to the vertical sections 101, 102.

Select embodiments of the present invention comprise a self-adjusting barrier 100 including a series of vertically mobile float units 104 restrained between a primary vertical section 101, such as a bulkhead, and a secondary vertical section 102, such as sheetpile. In select embodiments of the present invention, the secondary vertical section 102 may be connected to the primary vertical section 101 by braces 109. In select embodiments of the present invention, the braces 109 may be horizontal, i.e., approximately perpendicular to the primary 101 and secondary 102 vertical sections. In select embodiments of the present invention, the braces 109 may be attached to the primary 101 and secondary 102 vertical sections by welding, through bolts, gluing, or other acceptable means. In select embodiments of the present invention the float units 104 may comprise PVC or like material having a density less than water and being resistant to corrosion. In select embodiments of the present invention the primary vertical section 101 comprises sheet pile, concrete or like materials. In select embodiments of the present invention the secondary vertical section 102 comprises sheet pile or like material. In select embodiments of the present invention the float units 104 slidably interconnect along adjacent edges (depths).

In select embodiments of the present invention, the primary vertical section 101 is positioned on the dry (e.g., landward if a waterfront site) side of the configuration 100 and often performs as a retaining wall while providing structural support to the configuration 100. In select embodiments of the present invention, the secondary vertical section 102 is positioned approximately parallel to the primary vertical section 101 on the fluid (wet, e.g., seaward if a waterfront site) side of the configuration 100 and provides support and protection from such forces as wave impact to the float units 104.

In select embodiments of the present invention, the float units 104 comprise a series of individual units, the longitudinal axis of each approximately vertical, i.e., parallel to the primary 101 and secondary 102 vertical sections. In select embodiments of the present invention, float units 104 interconnect with adjacent float units via a tab and slot arrangement 301 or the like. In select embodiments of the present invention, the float units 104 are approximately rectangular in a cross section that is perpendicular to their longitudinal axis. In select embodiments of the present invention the length of the longitudinal axis of a float unit 104 is greater than the width of the float unit 104 and the width of the float unit 104 is approximately horizontal to the dry side (e.g., landmass adjacent a waterfront) 113 to be protected and the width of the float unit 104 is greater than the depth of the float unit 104 that is approximately perpendicular to the dry side 113 to be protected. In select embodiments of the present invention the length of the longitudinal axis of a float unit 104 is less than the width of the float unit 104 and the width of the float unit 104 is approximately horizontal to the dry side (e.g., landmass adjacent a waterfront) 113 to be protected and the width of the float unit 104 is greater than or equal to the depth of the float unit 104 that is approximately perpendicular to the dry side 113 to be protected.

Refer also to FIGS. 2, 4, 8, 12 and 14. In select embodiments of the present invention, the float units 104 are formed to include two guide slots 404 permitting the braces to pass through opposing longitudinal sides of the float units 104. These guide slots 404 allow vertical movement of the float units 104 with changes in water level. In their lowest position, select embodiments of the float units 104 rest on the braces 802. In select embodiments of the present invention, the space between the primary 101 and secondary 102 vertical sections is open to water flow either through holes 110 in the secondary vertical section 102 or between the bottom of the secondary section 102 and the bottom of the adjacent water body 112, or both, as shown by the arrow 206. In select embodiments of the present invention, the float units 104 are prevented from rising beyond a pre-specified design height. In select embodiments of the present invention, guides 1401 may be included on the vertical sections 101, 102 to improve stability of the float units 104 during a storm surge, especially if braces 109 are not needed between the vertical sections 101, 102.

Figure 6:
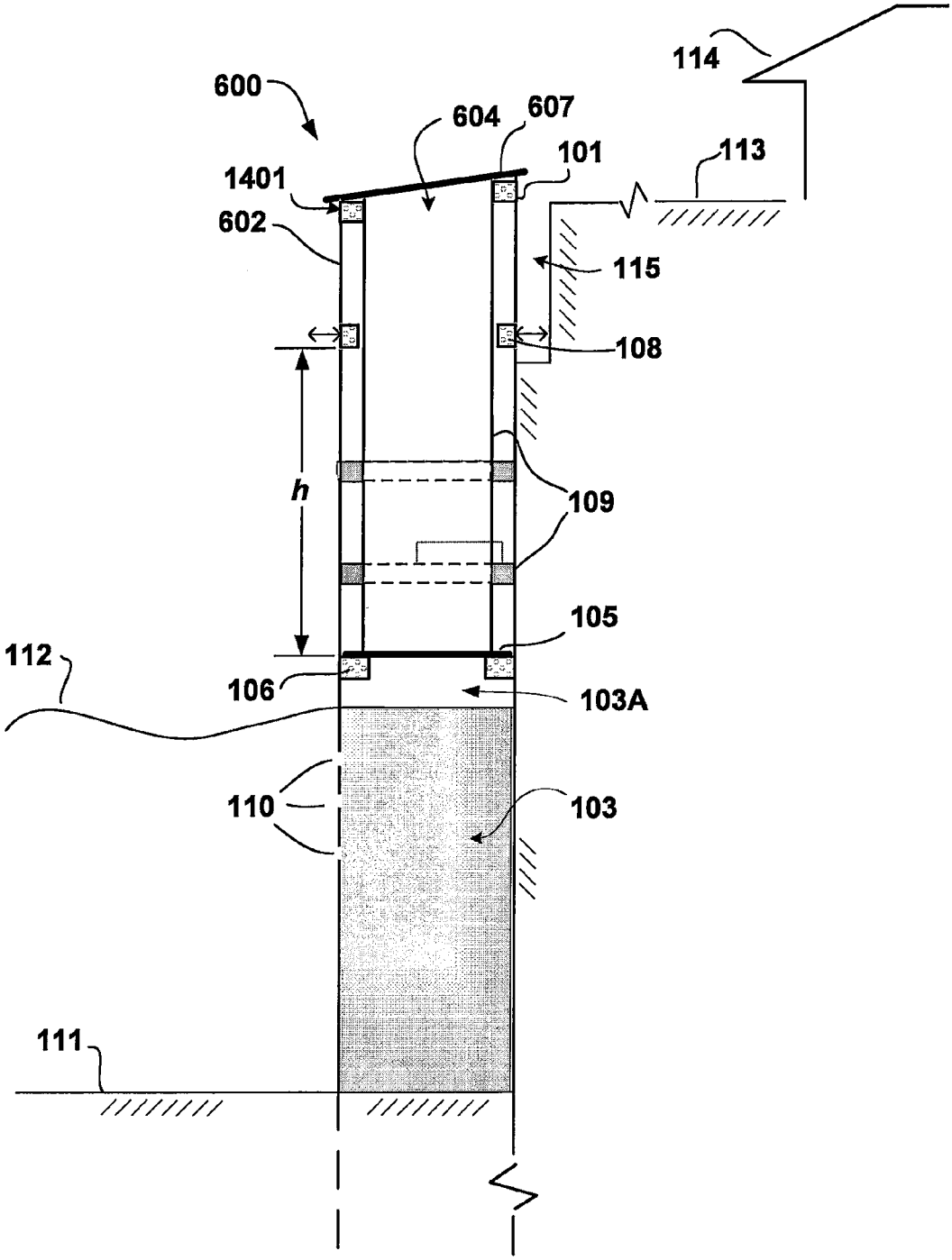
FIG. 6 is an edge view of an alternative to the embodiment shown in FIGS. 1-3.

Refer also to FIG. 6. In select embodiments of the present invention, a top plate 107, or cap, is attached to the float units 104. Since the top of a float unit 104 is level with the top of the primary 101 and secondary 102 vertical sections of select embodiments of the present invention, a top plate 107 on the float unit 104 may extend over the tops of both the primary 101 and secondary 102 vertical sections to reduce or eliminate fouling by debris and to provide an aesthetically pleasing top surface. In select embodiments of the present invention, the top plate 107 may be contiguous with the primary 101 and secondary 102 vertical sections or can overlap the primary 101 and secondary 102 vertical sections by some margin. The top plate 107 may also serve as a stop preventing the float unit 104 from sinking lower into the configuration, acting in conjunction with stops 106 provided at the bottom resting point of the float units 104, or, alternatively, providing the sole stop for the floating unit 104, i.e., serving in place of a stop 106. A top plate 607 may also be slanted to allow for run off of rain and dirt, the slant conforming to the top surface of a float unit 604.

Select embodiments of the present invention operate as follows. At normal water levels the float units 104 rest on horizontal braces 802, with the top plate 107 resting on the top of the primary 101 and secondary 102 vertical sections. This resting position provides a bulkhead configuration 800 that is low during calm seas, resulting in good views and easy waterside access. As the seas get turbulent, the water level rises and water enters the chamber 103 between the primary 101 and secondary 102 vertical sections. This causes the float units 104 to float, i.e., rise hydrostatically, in turn, raising the effective height of the configuration 800. The increased height reduces or eliminates flooding due to wave overtopping. The water-filled chamber 103 between the primary 101 and secondary 102 vertical sections acts as a stilling basin, thus the float units 104 rise smoothly without excessive displacement due to impacting waves. In select embodiments of the present invention, as the float units 104 rise to a pre-specified maximum height, stop bars or rods 801 engage the horizontal braces 802, preventing excessive vertical extension of the float unit 104. The float units 104 are held in a raised position for the duration of the rise in water level by the buoyant force of the submerged portion of the float unit 104. When the stilling basin level drops, the float units 104 lower hydrostatically with the still water level, returning to their resting position. The float units 104 may be sized to the needs of an individual site and the configuration tailored to control the amount of buoyant force available to lift the float units 104.

Select embodiments of the present invention as described above may not be water tight, e.g., some water may pass through any gaps between neighboring float units 104. Water and debris barriers may be added to select embodiments of the present invention to provide added protection against elevated still water levels. In select embodiments of the present invention, water barriers 501 that seal off the gaps between float units 104 may be attached to the top plate 107. The water barriers 501 are positioned by the float units 104 as they move vertically. In select embodiments of the present invention, water barriers 501 may be attached to the side of each float unit 104, overlapping the gap between a float unit 104 and its neighbor float unit 104 to provide some protection against water and debris intrusion. In select embodiments of the present invention, water barriers (seals) 501 may comprise a flexible material such as neoprene, rigid material such as aluminum plate, or both. In select embodiments of the present invention, water barriers 501 may be enclosed within protective plates (not shown separately) that are anchored on the dry side of the barrier 100 in order to protect the float units 104 from impact, fouling, vandalism, and the like.

Select embodiments of the present invention: reduce or eliminate flooding during storm surges, while allowing lower bulkhead elevations during calm sea states; are employable when tall conventional bulkheads are prohibited by local statute; employ without mechanical, electrical, or human effort; install on water side resulting in minimum encroachment on waterfront property; may be installed with initial bulkhead installation or retrofitted to existing bulkheads; incorporate braces that may be installed using conventional means; can accommodate steel sheetpile, concrete, and the like; are inexpensive as compared to the cost of providing pumps to prevent flooding; may be constructed with existing materials and technology; and may be installed with conventional equipment and without a cofferdam or dewatering.

EXAMPLES

Refer to FIG. 1. An embodiment 100 of the present invention is shown in a schematic form with a dry side wall 101 and a "braced" wet side wall 102 restraining a vertically mobile float unit 104 in a chamber 103 within the walls 101, 102. The wet side wall 102 may extend some distance into the floor 111 of the body of water 112 as shown in FIG. 1 or it may simply rely on a series of appropriately positioned braces 109 (FIGS. 1 and 2) to the dry side wall 101. The float unit 104 has a bottom plate 105 establishing a flange about the outer perimeter of the float unit 104. The flange of the bottom plate 105 rests on lower stops 106, thus supporting the float unit 104 in its "resting" state, i.e., when sea conditions are normal as at 112.

Refer to FIG. 8. As one alternative to the above described example, instead of multiple braces 109 and the flange on a bottom plate 105, the float units 104 incorporate two "stop rods" 801 that pass through holes through the width and near the bottom of each float unit 104 and a single location that may provide a pair of robust horizontal braces 802 for each float unit 104 as shown at FIGS. 11B and 11C. These stop rods 801 limit the vertical travel of the float units 104 when they contact the horizontal braces 802. The bottom of the float unit 104 may rest on the lower stops 106 or rely solely on a properly fastened top plate 107 to preclude the float unit from dropping to the water level in the chamber 103.

In select embodiments of the present invention, the "wet side" wall 102 is braced to the dry side wall 101 via a series of braces 109 placed in pre-specified locations along the walls 101, 102 in accordance with good engineering practice. Slots 404 (FIG. 4) in the float units 104 enable the float units 104 to move vertically while also permitting further use of the braces 109 as guides along which the float units 104 move.

In select embodiments of the present invention, a top plate (cap) 107 is provided for each of the float units 104. This top plate 107 prevents material from entering the chamber 103, deters vandalism if secure fastenings are used, and provides an aesthetic finished appearance when viewed from above.

In select embodiments of the present invention, the float units 104 are "slidably joined" via a slot-and-tab arrangement 301 (FIG. 3) such that individual float units 104 will move in one plane only with respect to the position of other such float units 104 within the structure (variable height bulkhead) 100 and not jam one another by skewing in the chamber 103.

In select embodiments of the present invention, fluid, e.g., water from a body of water, for producing the necessary hydrostatic force may be introduced at the bottom of the wet side vertical section 102 if the wet side vertical section 102 is not buried in the bed 111 of the body of water as seen at arrow 206 in FIG. 2. Alternatively, or in combination with the above means, entry ways (holes) 110 are provided in the wet side vertical section 102 to permit fluid, typically water, to rise hydrostatically within the chamber 103 to the level 112 of the water outside the chamber 103. As depicted in FIG. 1, the area above the shaded area in the chamber 103, shown as 103A, is empty since the water level 112 is normal. However, as shown in FIG. 2, during storm surges the entire chamber 103 may fill with water (FIG. 2, shaded area), thereby applying the hydrostatic force necessary to raise the float units 104 to their full height, h, above the dry side vertical section 101.

In select embodiments of the present invention, as shown in FIG. 1, the float unit 104 is in its resting position on stops 106 with water level 112 below the stops 106. The amount of vertical displacement of the float unit 104 is shown as h (FIG. 1). FIG. 2 depicts the float unit 104 at its full deployment, i.e., at a distance, h, above the top of the primary vertical section 101.

In select embodiments of the present invention, removable upper stops 108 are installed to prevent the float units 104 from floating out of the chamber 103 during a severe storm surge. The removable upper stops 108 also provide access for installation and maintenance of float units 104. As shown in FIG. 1, access to the primary vertical section 101 for installation of the upper stops 108 may be provided via a trench or "well" 115 along the structure 100 should the ground level 113 be near the top of the primary vertical section 101. In select embodiments of the present invention, "stop rods" 801 (FIG. 8) may be installed to contact a horizontal brace 802, as an alternative to the removable upper stops 108 of FIG. 1. As can be seen in FIG. 1, a person at the level of the structure 114 may have a clear view of the body of water, a view not otherwise constrained except in a storm surge as depicted in FIG. 2 with the float unit 104 "deployed" because of the higher water level 212.

Figure 7:
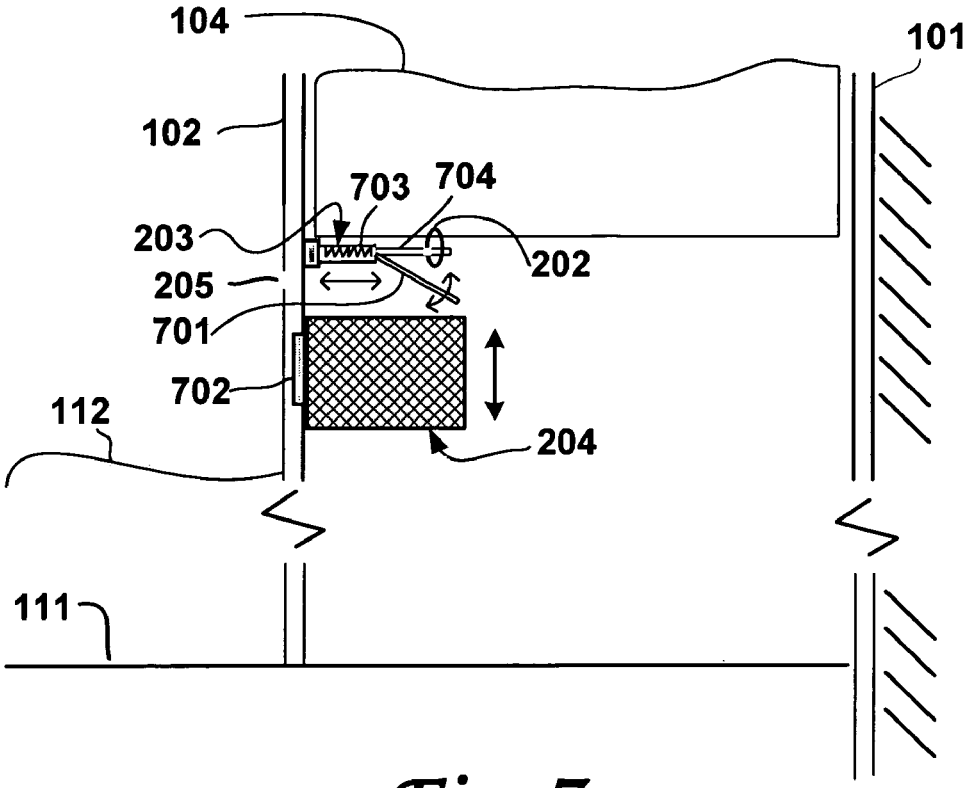
FIG. 7 is a detailed view of a mechanism that may be employed in select embodiments of the present invention to deter vandalism.

Refer to FIG. 2, depicting the float unit 104 in a deployed state because of the rise in water level from that at 112 to that at 212, resulting in the subsequent rise in the water level in the chamber 103. Also, note the additional braces 109 below the water level 112 as an alternative embodiment to burying the secondary vertical section 102 in the bottom 111. Again note that the view from structure 114 is blocked by the float units 104 of the variable height bulkhead 100 only during a storm surge. Also shown in FIG. 2, for select embodiments of the present invention, is a cover 201 for the trench 115. The cover 201 may serve two purposes, security against vandalism and prevention of debris buildup in the trench 115. Refer also to FIG. 7. Further, in select embodiments of the present invention, a locking mechanism 203 operates to prevent vandals from lifting individual float units 104 from the structure 100. The locking mechanism 203 provides a bar 704 that in normal sea conditions is locked horizontally through a ring 202 in the float unit 104. However, upon rising sea state a float 204 moves vertically in a slot and releases the bar 704 from its normal locked position allowing it to swing in a curve and release the locking mechanism 203 from the ring 202. In select embodiments of the present invention, a "keyway" 205 is provided for maintenance personnel to release the locking mechanism 203 by a tool (not shown separately) provided for that purpose.

Refer to FIGS. 3A and 3B. FIG. 3A is a perspective view of a select embodiment of the present invention using sheet pile for both the primary vertical section 101 and the secondary vertical section 102. The position of the slot-and-tab arrangement 301, approximately centered on the edge of each float unit 104 is apparent as is the position of the removable top stops 108 and the entry ways 110 for supplying the fluid, typically water, to the chamber 103 to impose the necessary hydrostatic force to raise the float units 104. To enhance clarity, the top plate 107 is not shown except via dashed lines over one float unit 104. The top plate 107 is affixed to move with the float unit 104. FIG. 3B provides a top view of the embodiment of FIG. 3A, showing the relative position of the braces 109, the top plate 107, the vertical sections 101, 102 and the float units 104 as slidably connected via the slot-and-tab arrangement 301.

Figure 11:
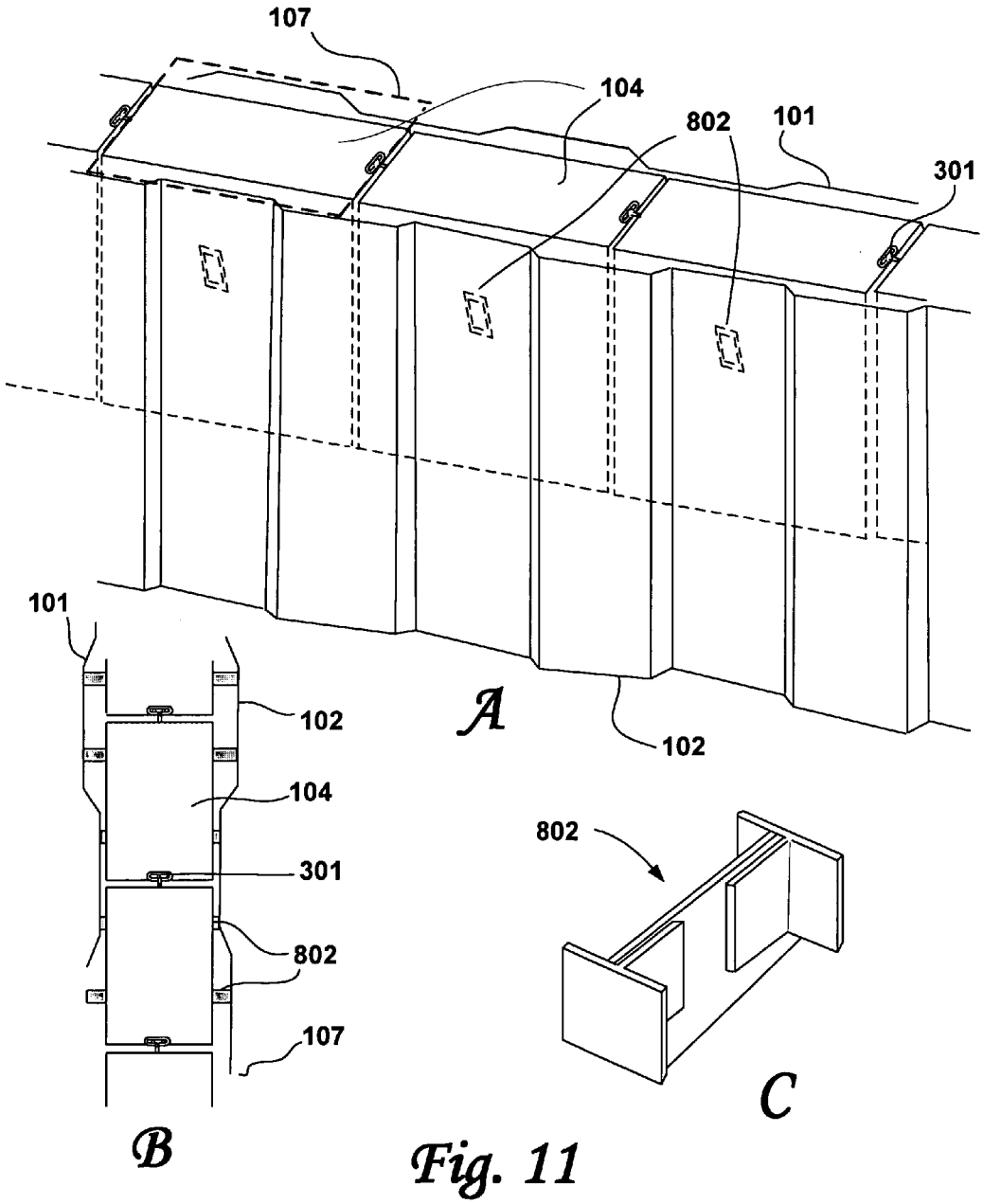
FIG. 11A is a perspective view of an alternative to the embodiment of FIG. 3A that also employs sheet pile as containment for the embodiment.
FIG. 11B is a top view of a select embodiment of the present invention as represented in FIG. 11A.
FIG. 11C is a perspective view of the bracing that may be used in the embodiment of FIGS. 11A and 11B.
Figure 12:
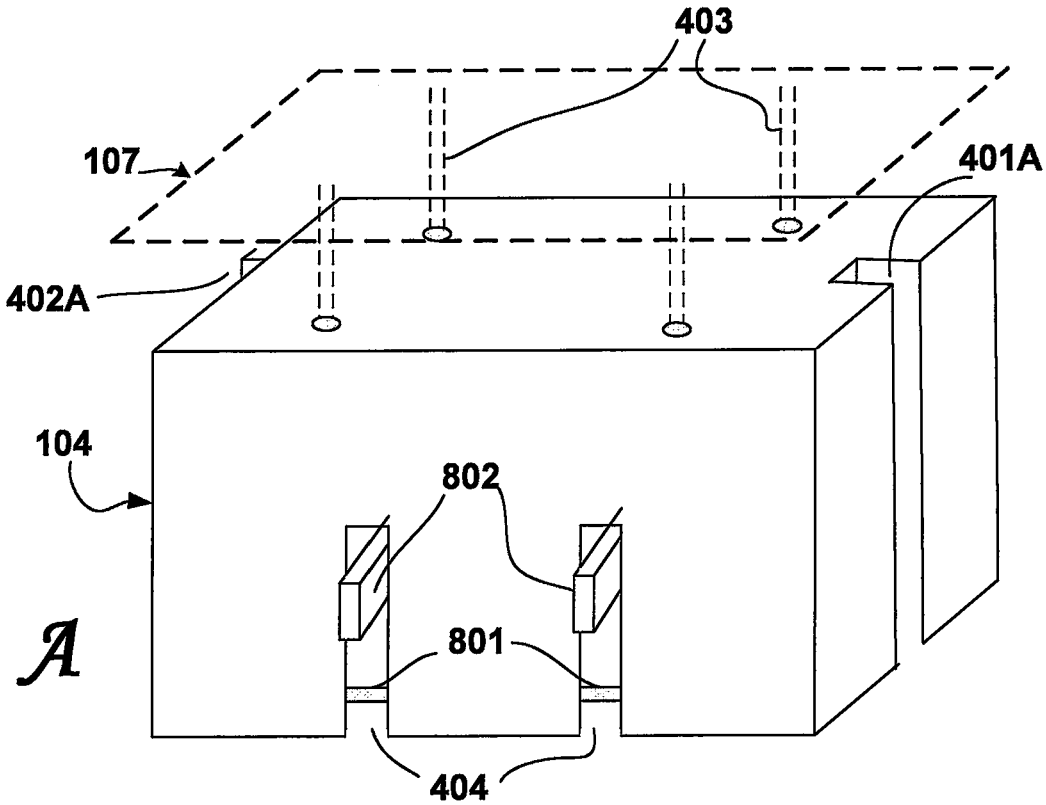
FIG. 12A is an edge view of a first alternative to the embodiment shown in FIGS. 8-11 and 13.
FIG. 12B is an edge view of a second alternative to the embodiment shown in FIGS. 8-11 and 13.
Figure 12:
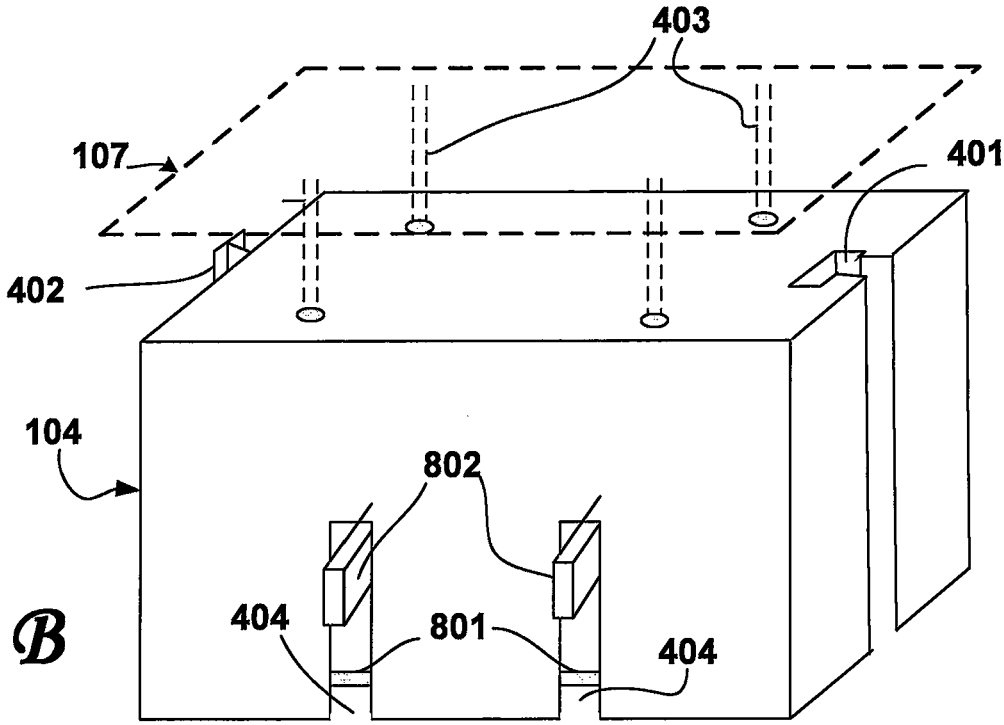

Refer to FIG. 4, illustrating a single float unit 104 as may be employed in select embodiments of the present invention. A typical T-shaped slot 401 and corresponding tab 402 are shown for slidably connecting multiple float units 104. Refer to FIG. 12A for other like arrangements using simple rectangular slots 401A and corresponding tabs 402A that allow float units 104 to slide while remaining connected as envisioned by embodiments of the present invention as shown in FIG. 12A in which the single robust horizontal brace 802 of FIG. 11C is used. In FIG. 4, two braces 109 are shown in each of slots 404 for illustrative purposes whereas a single robust brace 802 is shown per slot 404 in FIGS. 12A and 12B. Although braces 109, 802 are shown in rectangular cross section stabilizing the float unit 104 via two slots 404, other arrangements including cylindrical, tubular, and the like cross sections are envisioned by embodiments of the present invention as well as single slots 404 or more than two slots 404. The flange integral to the bottom plate 105 is also evident in FIG. 4, whereas embodiments represented by FIGS. 8-12, using stop bars 801, require no flange. In select embodiments of the present invention, the top plate 107 may be fastened via appropriate secure means such as via through bolts (as shown at 403) having special heads and the like.

In select embodiments of the present invention, sheet pile may be used for both the primary vertical sections 101 and the secondary vertical sections 102 or just for the secondary vertical sections 102. Other suitable conventional construction materials may be used for either of the vertical sections 101, 102, including treated wood, concrete, composites, and the like.

In select embodiments of the present invention, the float units 104 comprise one or more materials, the resultant composition of all materials having a density less than water. In select embodiments of the present invention, the float units 104 comprise a material impervious to corrosion from moisture. In select embodiments of the present invention, the float units 104 are substantially solid. In select embodiments of the present invention, the float units 104 incorporate at least one void sealed from moisture intrusion. In select embodiments of the present invention, the float units comprise one or more materials selected from: closed cell foams, PVCs, carbon fibers, corrosion resistant metal alloys, fiberglass, fiber reinforced plastics (FRPs), aramids, polyesters, vinyls, and combinations thereof.

Refer to FIG. 5, depicting a top plate 107 that may be used in select embodiments of the present invention. To further prevent intrusion of debris, sand, dust, and water, top plates 107 may be fitted with seals 501 that overlap each float unit 104. The seals 501 may comprise materials conventionally used for this purpose including any of commercially available composites, silicones, rubber, specialty composites, and combinations thereof, in particular those materials having both UV resistance and abrasion resistance.

Refer to FIG. 6, depicting an alternative geometry 600 to the structure 100. To provide a "self-cleaning" capacity, the secondary vertical section 602 is shorter than the primary vertical section 101, enabling both the "slant top" float unit 604 and its corresponding top plate 607 to be slanted toward the wet side to provide for "washing off" the top of the structure 600 during a rain or wind storm. This configuration would also facilitate performance of those embodiments incorporating the seals 501 (FIG. 5), i.e., preclude pooling of water thereon.

Refer to FIG. 7, further illustrating the mechanism 203 of FIG. 2 as may be employed to deter vandalism of the float units. The float 204 rides in a slot in the secondary vertical section 102 via the tab 702. As the fluid in the stilling basin rises, the float 204 contacts the lever 701 that compresses a spring 703 inside the mechanism 203 that pulls the locking lever 704 from the ring 202 on the float unit 104. Upon a reduction in water level (as shown at 112) the float 204 releases tension on the spring 703 only after the float unit 104 is positioned such that the ring 202 is located in a proper position for the locking lever 704 to again engage the ring 202. Other mechanisms for securing the float unit 104 from ready removal by vandals may be envisioned by those skilled in the art and the mechanism of FIG. 7 is but one way of carrying out an embodiment of the present invention that is employed to deter vandalism.

Compare the configuration 800 of FIG. 8 to that of FIG. 2. There is but one robust horizontal brace 802 as compared to multiple horizontal braces 109 in that of FIG. 2. Further, in place of the complex vandal proof mechanism 202 through 205 of FIG. 2, the configuration 800 uses a pair of rods 801 inserted near the bottom of the float units 104 and parallel to the vertical sections 101, 102 to act as "stop bars" to both prevent the float units 104 from floating out of their chambers 103 but also to prevent vandals from taking individual float units 104. Should the top plate 107 of the configuration 800 be sufficient to hold the float unit 104 above the water level at rest, then even the bottom rests 106 would not be necessary in the simple configuration 800. Also note that the configuration 800 does not require a well 115 or top 201 therefor, further reducing costs while also increasing the strength of the configuration 800 at the top where it is needed in the event of a serious storm surge.

Figure 9:
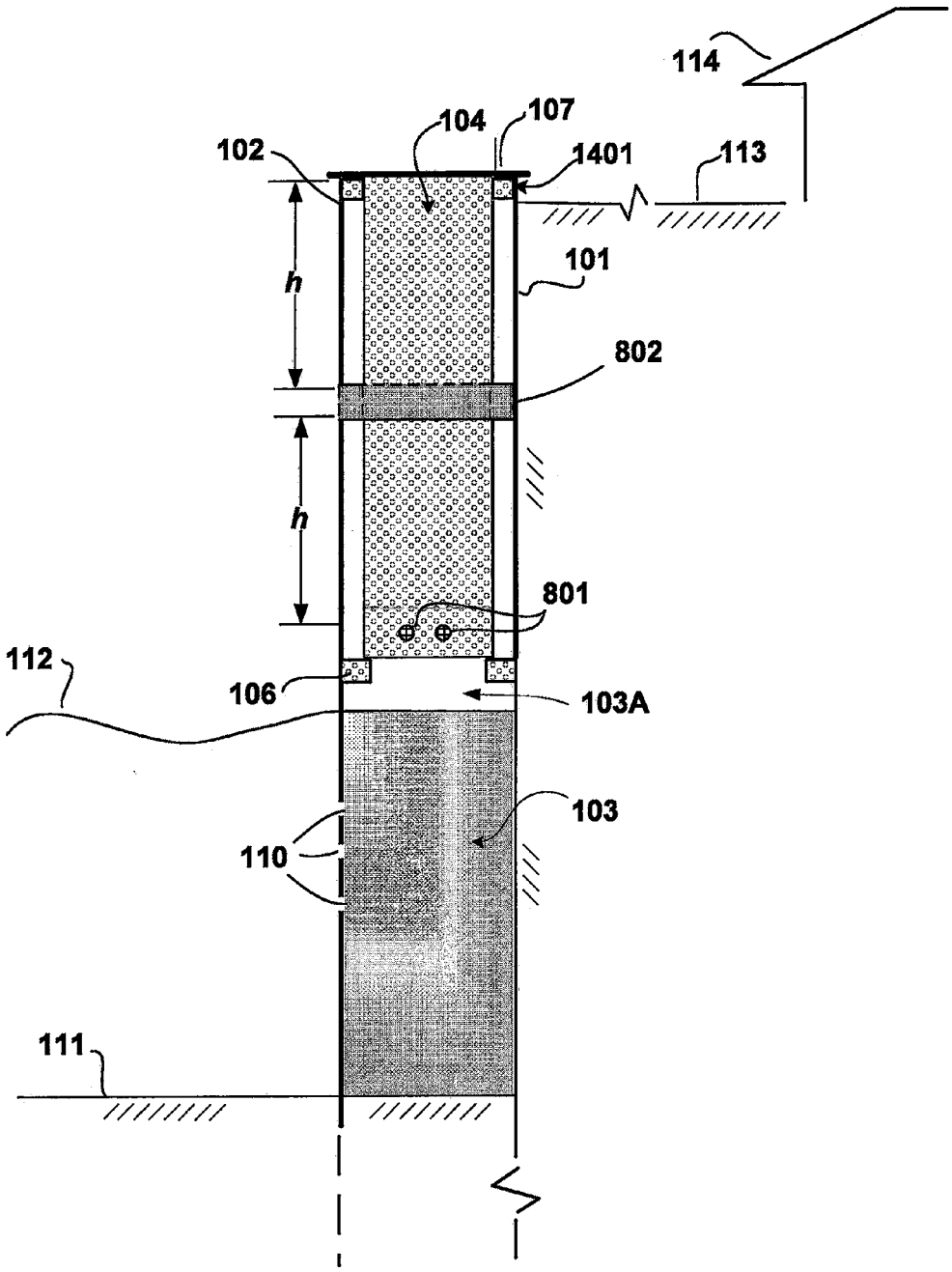
FIG. 9 is an edge view of an alternative to the embodiment of FIG. 8, also in an un-extended position.

Refer to FIG. 9, an alternate embodiment of FIG. 8 with the added length of the secondary vertical section 102 extending into the bed 111 of the body of water, necessitating the addition of inlet passage (holes) 110 in the sides of the vertical structure to permit timely filling of the chamber 103.

Figure 10:
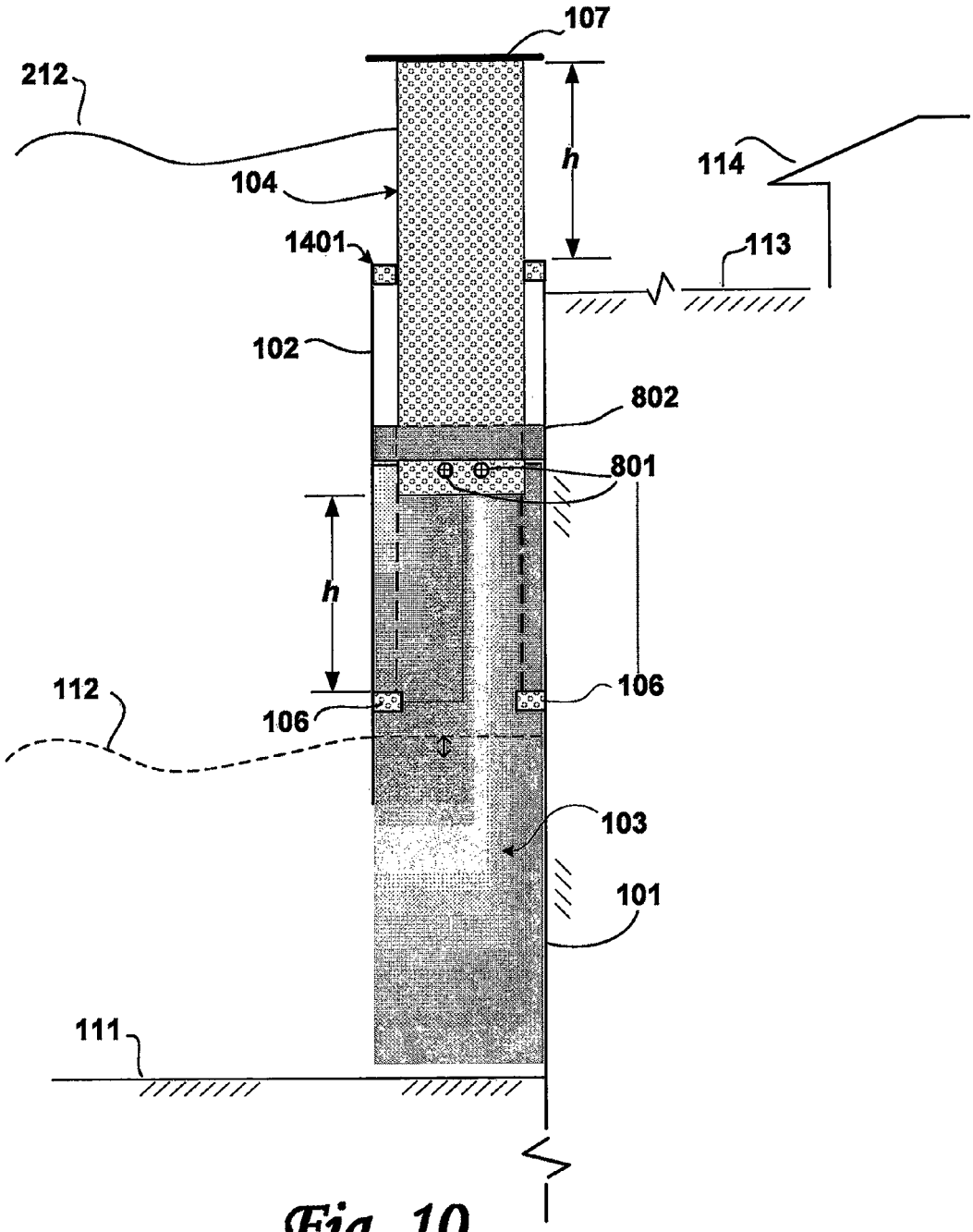
FIG. 10 is an edge view of the embodiment of FIG. 8 in an extended position.

Refer to FIG. 10, depicting the float units 104 of FIG. 8 in the extended position, clearly showing the function of the rods 801 as stop bars against the robust horizontal brace 802.

Compare FIGS. 11A and 11B, showing a perspective and top view, respectively of installed configuration of FIG. 8 to FIGS. 3A and 3B, showing a perspective and top view, respectively of installed configuration of FIG. 1. FIG. 11C shows a perspective of a robust horizontal brace 802 that may be used near the top of the vertical sections 101, 102 in select embodiments of the present invention in place of multiple horizontal braces 109 as shown in FIG. 1. Also shown in FIG. 11A is a perspective of multiple installed floating units 104 of FIG. 8 in which no "passage ways" 110 are needed through the secondary vertical section 102 since the secondary vertical section 102 does not extend to the bottom 111 of the waterway.

Figure 13:
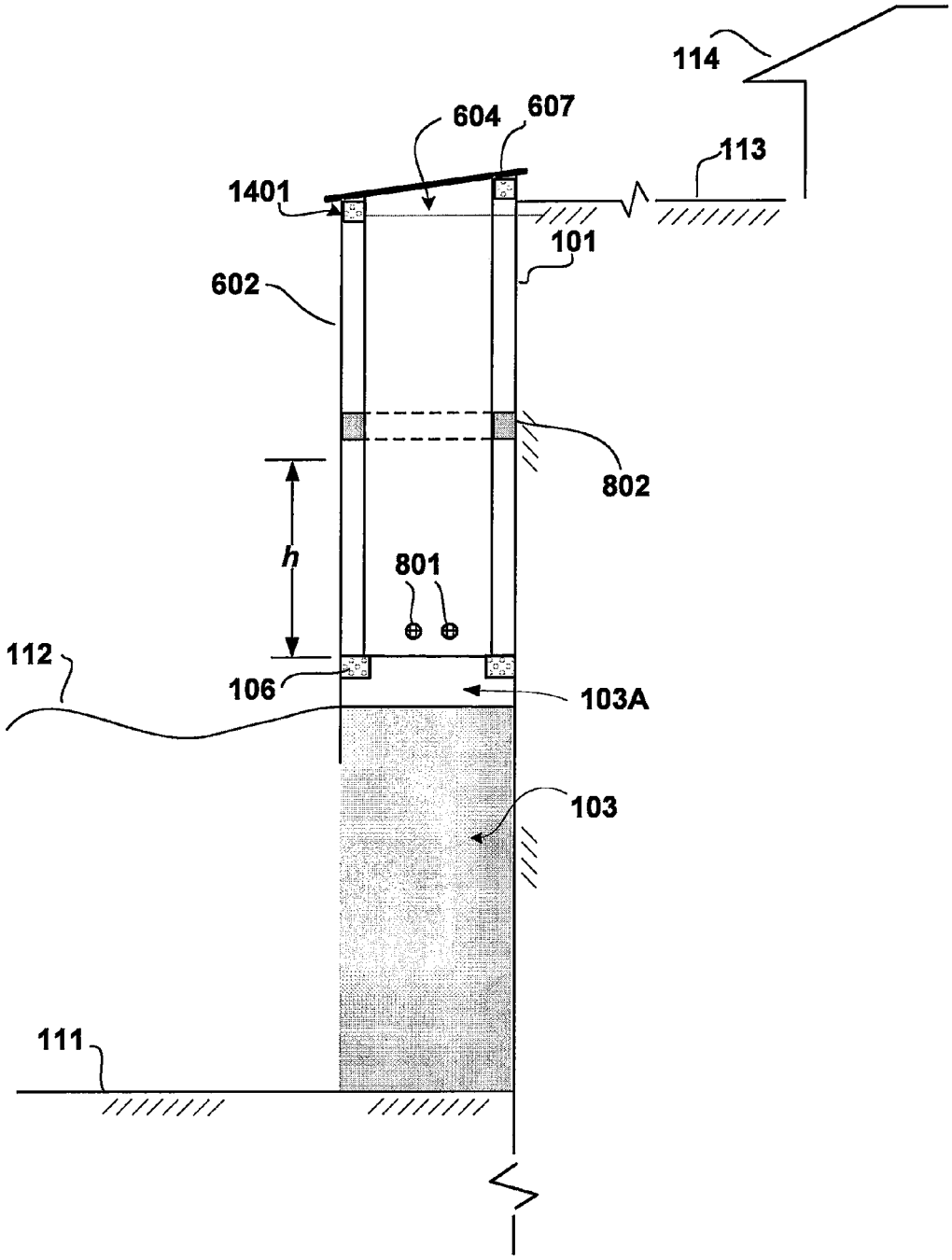
FIG. 13 is an edge view of an alternative to the embodiment shown in FIG. 8.

Compare the slant top 607 and slant-topped floating unit 604 of FIG. 13 to the similar items of FIG. 6. The same "self-washing" configuration is used for both, the configuration of FIG. 13 being an alternate embodiment of FIG. 8 differing in that the top plate 107 and top of the floating units 104 of the configuration of FIG. 8 are flat, i.e., horizontal.

Figure 14:
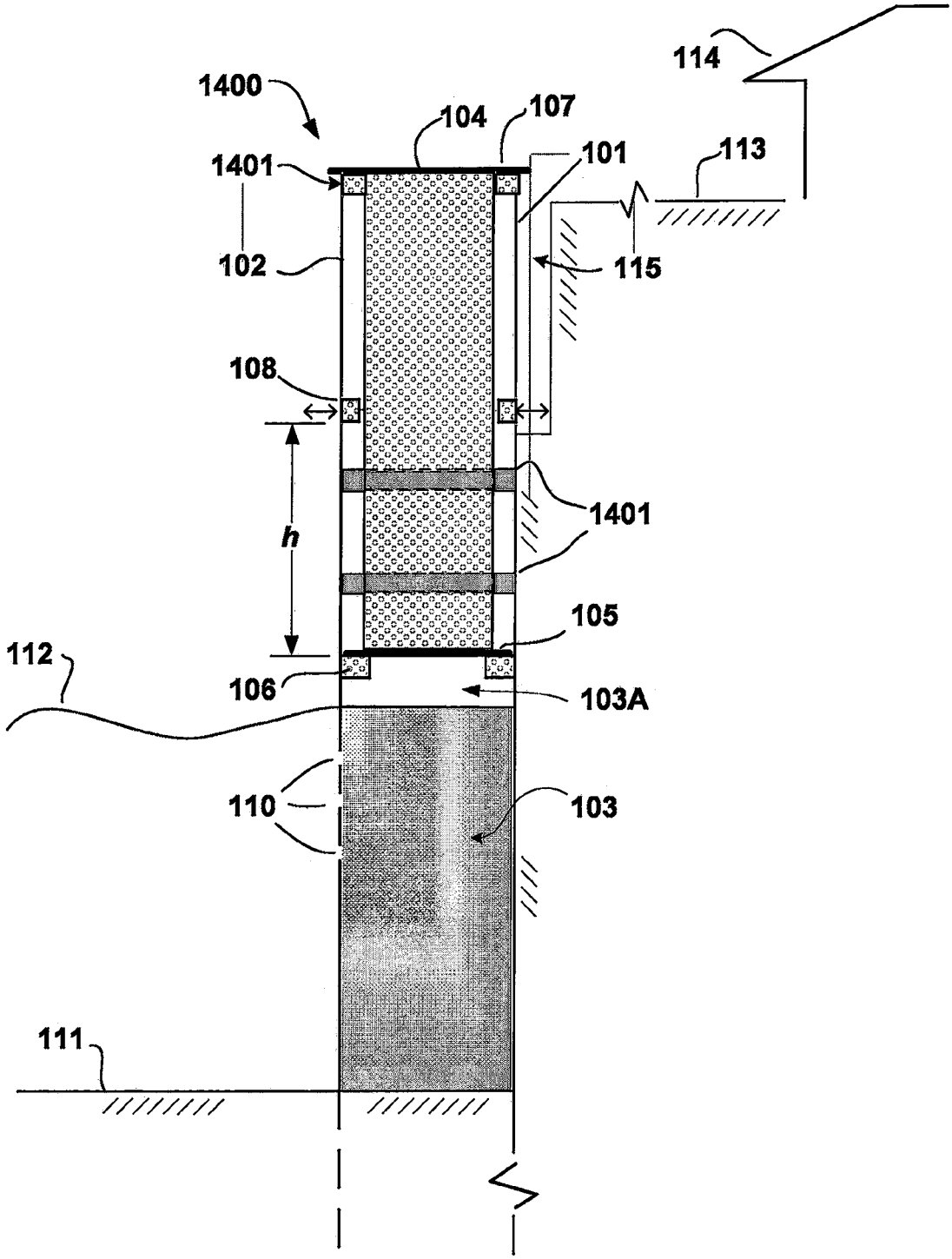
FIG. 14 is an edge view of an alternative to the embodiment shown in FIG. 1 in which guides rather than braces are employed.

Refer to FIG. 14, an alternate embodiment 1400 of FIG. 1 with the use of guides 1401 in place of braces 109. If the user does not require the added bracing, the configuration 1400 is adequate, reducing the complexity of manufacture of the float units 104 and installation of the vertical sections 101, 102.

The abstract of the disclosure is provided to comply with the rules requiring an abstract that will allow a searcher to quickly ascertain the subject matter of the technical disclosure of any patent issued from this disclosure. 37 CFR §1.72 (b). Any advantages and benefits described may not apply to all embodiments of the invention.

While the invention has been described in terms of some of its embodiments, those skilled in the art will recognize that the invention can be practiced with modifications within the spirit and scope of the appended claims. For example, although the system is described in specific examples for use in protecting a marina or waterfront property, it may be used for any type of "overflow" control for which overflow is a remote occurrence. Thus select embodiments of the present invention may be useful in such diverse applications as manufacturing, mining, smelting, refining, re-cycling, remediating, power production, and the like. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Thus, it is intended that all matter contained in the foregoing description or shown in the accompanying drawings shall be interpreted as illustrative rather than limiting, and the invention should be defined only in accordance with the following claims and their equivalents.

We claim:

1. A self-adjusting barrier readily accessible for maintenance and repair, comprising:

at least one first vertical section;

at least one second vertical section spaced apart from said first vertical section thereby creating a chamber between said first and second vertical sections, said second vertical section rising to approximately the same height as said first vertical section and in approximately parallel relation to said first vertical section, wherein said barrier incorporates at least one passage way permitting fluid to penetrate said chamber, said chamber subsequently serving as a stilling basin;

at least one pair of guides, said guides in each said pair opposing each other in the same plane, one each said guide on said vertical section and said existing barrier, one each said guide of one said pair of guides located at the top inside of said first and second vertical sections;

braces placed approximately horizontally between said first and second vertical sections;

at least one float unit slidably restrained in said chamber, said at least one float unit to be lifted by hydrostatic force to increase the capacity of said self-adjusting barrier to contain additional fluid on one side of said self-adjusting barrier, each said at least one float unit formed to include at least one guide slot permitting said braces to pass through opposing longitudinal sides of said at least one float unit, wherein said guide slots allow only approximately vertical movement of said at least one float unit with changes in fluid level within said chamber, and wherein the longitudinal axis of said at least one float unit is approximately vertical and approximately parallel to said first and second vertical sections.

2. The self-adjusting barrier of claim 1 in which said float unit is approximately rectangular in cross section, wherein said cross section is perpendicular to said longitudinal axis.

3. The self-adjusting barrier of claim 1 in which the length of said longitudinal axis is greater than the width of said float unit and the width of said float unit is approximately parallel to said vertical sections, said width being greater than the depth of said float unit, and said depth being approximately perpendicular to said vertical sections.

4. The self-adjusting barrier of claim 1 in which said first and second vertical sections comprise sheet pile.

5. The self-adjusting barrier of claim 1 in which said first vertical section comprises a bulkhead.

6. The self-adjusting barrier of claim 1 in which said braces are attached to said first and second vertical sections by means selected from the group consisting of welds, through bolts, glues, nails, screws, and combinations thereof.

7. The self-adjusting barrier of claim 1 in which said float units comprise material having a density less than water, said material being resistant to corrosion.

8. The self-adjusting barrier of claim 1 in which multiple said float units are slidably interconnected in one plane, said plane coincident with said longitudinal axis of said float units and approximately parallel to said first vertical section.

9. The self-adjusting barrier of claim 8 in which said float units slidably interconnect with adjacent said float units via a tab and slot arrangement.

10. The self-adjusting barrier of claim 1 in which said vertical sections incorporate removable keyed stops and said float units incorporate at least a flange on the bottom of each said float unit, wherein said flange prevents said float units from rising beyond a pre-specified design elevation by contact with said keyed stops on said vertical sections, and wherein said keyed stops prevent vandalism while facilitating installation and maintenance of said barrier.

11. The self-adjusting barrier of claim 10 in which said vertical sections incorporate resting stops, wherein said flange of said float unit contacts said resting stops, supporting said float unit when conditions are normal and overtopping is not imminent.

12. The self-adjusting barrier of claim 1 in which said float unit incorporates a top plate, wherein said top plate extends over the tops of both said first and second vertical sections to reduce fouling by debris and to provide an aesthetically pleasing top surface, and wherein said top plate may serve as a stop preventing said float unit from sinking lower into said chamber.

13. The self-adjusting barrier of claim 12 in which said top plate slants toward said second vertical section from said first vertical section, said second vertical section being at a lower height than said first vertical section.

14. The self-adjusting barrier of claim 12 in which said top plate incorporates seals that close any gap between said float units.

15. The self-adjusting barrier of claim 14 in which said seals are selected from materials consisting of: flexible material, neoprene, rigid material, aluminum plate, and combinations thereof.

16. The self-adjusting barrier of claim 1 in which at least one said vertical section is buried in the earth to facilitate stabilizing said barrier.

17. The self-adjusting barrier of claim 1 in which each said float unit incorporates at least one keyed anchorage to at least one said vertical section, said at least one keyed anchorage latching said at least float unit to said at least one said vertical section until an event causes the fluid in said chamber to float said at least one float unit thereby moving said at least one float unit vertically in said chamber, wherein said keyed anchorage prevents vandals from lifting said float units from said barrier, while facilitating maintenance on said bather.

18. The self-adjusting barrier of claim 1 in which said at least one float unit incorporates at least one rod located near the bottom of said at least one float unit approximately no more than $1/8^{th}$ of the length of said at least one float unit from said bottom, wherein said at least one rod prevents said at least one float unit from rising beyond a pre-specified height by contact with said brace, and wherein said at least one rod deters vandalism while facilitating installation and maintenance of said barrier.

19. The self-adjusting barrier of claim 1 in which said barrier incorporates at least one water and debris seal, wherein said seal protects against elevated stilling basin levels.

20. A method for employing a self-adjusting barrier to prevent fluid overtopping comprising:

providing at least one first vertical section;

providing at least one second vertical section spaced apart from said first vertical section thereby creating a chamber between said first and second vertical sections, said second vertical section rising to approximately the same height as said first vertical section and in approximately parallel relation to said first vertical section, wherein said barrier incorporates at least one passage way permitting said fluid to penetrate said chamber, said chamber subsequently serving as a stilling basin;

providing at least one float unit slidably restrained in said chamber, said at least one float unit to be lifted by hydrostatic force to increase the capacity of said barrier to withstand said overtopping, each said at least one float unit formed to include at least one guide slot permitting said braces to pass through opposing longitudinal sides of said at least one float unit, wherein said guide slots allow only approximately vertical movement of said at least one float unit with changes in fluid level within said stilling basin, and wherein the longitudinal axis of said float unit is approximately vertical and parallel to said first and second vertical section;

providing at least one pair of guides, said guides in each pair opposing each other, one each of said pair on said first and second vertical sections, at least one said pair of guides located at the top of the inside of said first and second vertical sections; and providing braces placed approximately horizontally between said first and second vertical sections.

21. A method for adding a self-adjusting barrier to an existing bulkhead to prevent fluid overtopping of said bulkhead, comprising:

providing at least one vertical section spaced apart from said bulkhead thereby creating a chamber between said vertical section and said bulkhead, said vertical section rising to approximately the same height as said bulkhead and in approximately parallel relation to said bulkhead, wherein said vertical section incorporates at least one passage way permitting said fluid to penetrate said chamber, said chamber subsequently serving as a stilling basin;

providing at least one float unit slidably restrained in said chamber, said float unit to be lifted by hydrostatic force to increase the capacity of said bulkhead to withstand said overtopping, providing at least one float unit slidably restrained in said chamber, said at least one float unit to be lifted by hydrostatic force to increase the capacity of said barrier to withstand said overtopping, each said at least one float unit formed to include at least one guide slot permitting said braces to pass through opposing longitudinal sides of said at least one float unit, wherein said guide slots allow only approximately vertical movement of said at least one float unit with changes in fluid level within said stilling basin, and wherein the longitudinal axis of said at least one float unit is approximately vertical and parallel to said vertical section and said bulkhead;

providing at least one pair of guides, said guides in each pair opposing each other in the same plane, one each of said pair on said at least one vertical section and said bulkhead, at least one said pair of guides located at the top of the inside of said at least one vertical section and said bulkhead, respectively; and providing braces placed approximately horizontally between said at least one vertical section and said bulkhead.

22. A self-adjusting barrier readily accessible for maintenance and repair, comprising:

at least one vertical section spaced apart from an existing vertical barrier thereby creating a chamber between said at least one vertical section and said existing vertical bather, said at least one vertical section rising to approximately the same height as said existing vertical barrier and in approximately parallel relation to said existing vertical bather, wherein said self-adjusting bather incorporates at least one passage way permitting fluid to penetrate said chamber, said chamber subsequently serving as a stilling basin;

at least one pair of guides, said guides in each said pair opposing each other in the same plane, one each said guide on said vertical section and said existing bather, one each said guide of one said pair of guides located at the top inside of said vertical section and said existing bather, respectively;

braces placed approximately horizontally between said at least one vertical section and said existing bather;

at least one float unit slidably restrained in said chamber, said at least one float unit to be lifted by hydrostatic force to increase the capacity of said self-adjusting bather to contain additional fluid on one side of said self-adjusting bather, each said at least one float unit formed to include at least one guide slot permitting said braces to pass through opposing longitudinal sides of said at least one float unit, wherein said at least one guide slot allows only approximately vertical movement of said at least one float unit with changes in fluid level within said stilling basin, and wherein the longitudinal axis of said at least one float unit is approximately vertical and approximately parallel to said at least one vertical section.

23. The self-adjusting barrier of claim 22 in which said at least one float unit is approximately rectangular in cross section, wherein said cross section is perpendicular to said longitudinal axis.

24. The self-adjusting barrier of claim 22 in which the length of said longitudinal axis greater than the width of said at least one float unit and the width of said at least one float unit is approximately parallel to said vertical sections, said width being greater than the depth of said at least one float unit, and said depth being approximately perpendicular to said at least one vertical section.

25. The self-adjusting barrier of claim 22 in which said at least one vertical section comprises sheet pile.

* * * * *